US006792908B1

(12) United States Patent
Shimizu

(10) Patent No.: US 6,792,908 B1
(45) Date of Patent: Sep. 21, 2004

(54) RECOIL ASSEMBLY FOR A PULL STARTER

(75) Inventor: Keizo Shimizu, Poplar Bluff, MO (US)

(73) Assignees: Starting Industrial Co., Ltd., Tokyo (JP); Starting USA Corporation, Poplar Bluff, MO (US)

( * ) Notice: Subject to any disclaimer, the term of this patent is extended or adjusted under 35 U.S.C. 154(b) by 0 days.

(21) Appl. No.: 10/603,968

(22) Filed: Jun. 25, 2003

(51) Int. Cl.[7] ..... F02N 3/02
(52) U.S. Cl. ..... 123/185.3; 185/45
(58) Field of Search ..... 123/185.2, 185.3, 123/185.4; 185/45; 267/167

(56) References Cited

U.S. PATENT DOCUMENTS

| | | | |
|---|---|---|---|
| 2,204,750 | A | 6/1940 | Conover |
| 2,530,623 | A | 11/1950 | Martin |
| 2,563,719 | A | 8/1951 | Goldberg et al. |
| 2,848,987 | A | 8/1958 | Morden |
| 3,091,447 | A | 5/1963 | Donkin |
| 3,127,884 | A | 4/1964 | Rice |
| 3,375,813 | A | 4/1968 | Hamman |
| 3,375,814 | A | 4/1968 | Hamman |
| 3,393,707 | A | 7/1968 | Whiting |
| 3,739,763 | A | 6/1973 | Berry et al. |
| 3,782,355 | A | 1/1974 | Hamman |
| 3,788,631 | A | 1/1974 | Aldous |
| 3,858,566 | A | 1/1975 | Perry |
| 4,019,490 | A | 4/1977 | Reese |
| 4,068,644 | A | 1/1978 | Newport |
| 4,091,788 | A | 5/1978 | Burmeister et al. |
| 4,261,437 | A | 4/1981 | Zavatkay et al. |
| 4,291,654 | A | 9/1981 | Obermayer |
| 4,492,190 | A | 1/1985 | Greenwood et al. |
| 4,582,030 | A | 4/1986 | Reese |
| 4,658,775 | A | 4/1987 | Greenwood et al. |
| 4,732,121 | A | 3/1988 | Miyata et al. |
| 4,850,233 | A | 7/1989 | Ishigo |
| 5,067,451 | A | 11/1991 | Tyler |
| 5,287,832 | A | 2/1994 | Uhl |
| 5,361,738 | A | 11/1994 | Iida |
| 5,431,135 | A | 7/1995 | Tyler |
| 6,588,390 | B2 | 7/2003 | Kawasaki et al. |
| 6,739,303 | B2 * | 5/2004 | Harada et al. ..... 123/185.14 |
| 2004/0065289 | A1 * | 4/2004 | Leasure et al. ..... 123/185.4 |

* cited by examiner

*Primary Examiner*—Mahmoud Gumme
(74) *Attorney, Agent, or Firm*—Michael Best & Friedrich LLP

(57) ABSTRACT

A recoil starter including a winding housing and a reel that is rotatably coupled of the winding housing for rotation about a central axis. The winding housing includes a spring tab that is spaced from the central axis. The recoil starter also includes a spirally wound spring having an outer end portion that is coupled to the heel, a coiled portion that extends around the central axis, a guide portion that extends between the central axis and the spring tab, and a hook portions that extends radially outwardly from the central axis and that engages the spring tab to restrict movement of the inner end with respect to the winding housing.

20 Claims, 5 Drawing Sheets

RECOIL ASSEMBLY FOR A PULL STARTER

FIELD OF THE INVENTION

The invention relates to a recoil assembly for a pull starter such as those found on small internal combustion engines.

BACKGROUND

Recoil starters are commonly installed on small internal combustion engines for manual starting of the engine. Examples of products having engines equipped with a recoil starter include lawnmowers, snowblowers, leaf blowers, pressure washers, generators, and the like. Known recoil starters include a starter rope that is pulled by an operator to rotate a reel. The reel is coupled to the crankshaft of an engine for imparting rotation thereto only when the reel is rotated in one direction with respect to the crankshaft. After the engine is started, the reel is free to rotate with respect to the crankshaft and generally remains substantially stationary during engine operation. A recoil spring is provided such that the starter rope is automatically rewound upon the reel after the engine is started.

SUMMARY OF THE INVENTION

The present invention provides a recoil starter including a winding housing and a reel that is rotatably coupled to the winding housing for rotation about a central axis. The winding housing includes a first surface and a spring tab that is spaced from the central axis and that extends from the first surface. The recoil starter also includes a spirally wound spring. The spirally wound spring includes an outer end portion that is coupled to the reel, a coiled portion that extends around the central axis, and an inner end portion. The inner end portion of the spring includes a guide portion that extends between the central axis and the spring tab, and a hook portion that extends radially outwardly from the central axis and that engages the spring tab to restrict movement of the inner end with respect to the winding housing. The spirally wound spring is generally an elongated strip that has a first surface and a second surface, and is configured such that the first surface faces radially outwardly and the second surface faces radially inwardly in the coiled portion, and such that the first surface generally faces and/or engages the spring tab.

Other features of the invention will become apparent to those skilled in the art upon review of the following detailed description, claims, and drawings.

Figure 1:
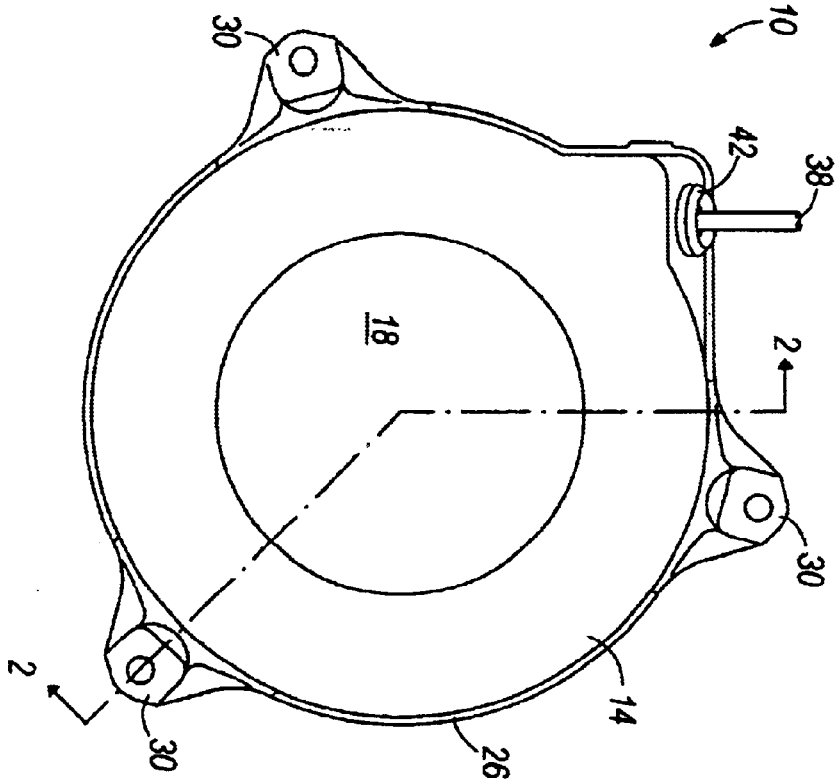
FIG. 1 is a top view of a recoil starter embodying the invention.
Figure 2:
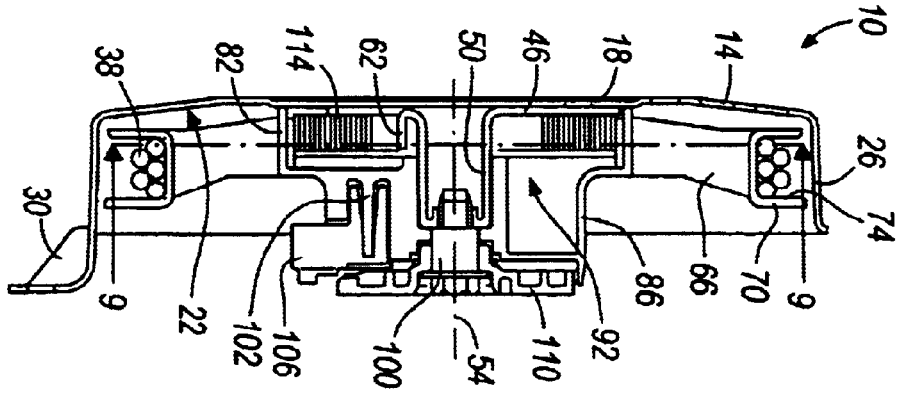
FIG. 2 is a section view along line 2—2 of FIG. 1.
Figure 3:
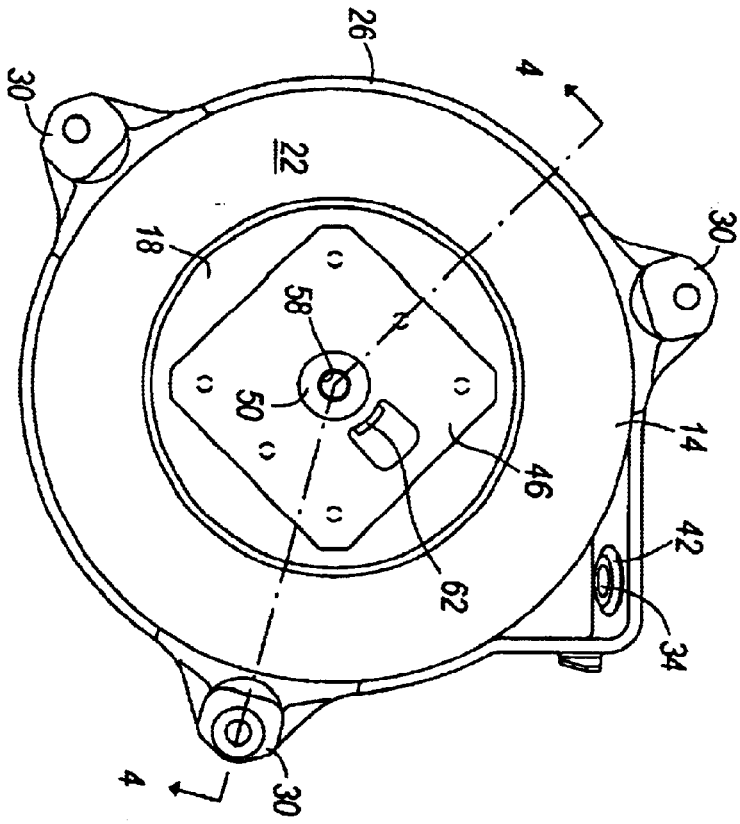
FIG. 3 is a bottom view of a winding housing of the recoil starter illustrated in FIG. 1.
Figure 4:
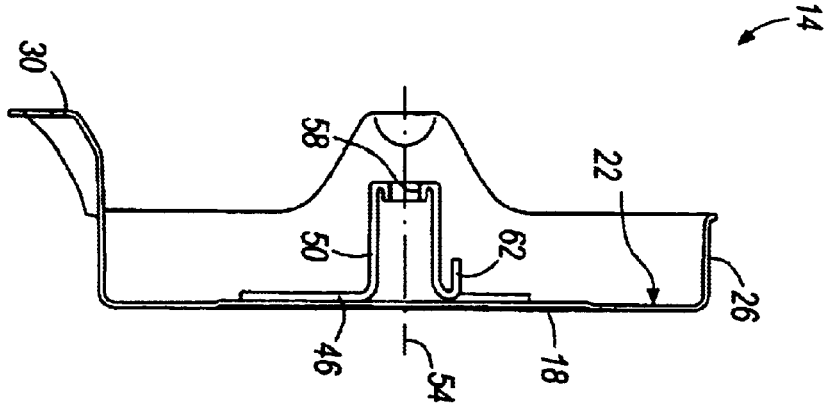
FIG. 4 is a section view taken along line 4—4 of FIG. 3.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

The figures illustrate a recoil starter 10 embodying the invention. With reference to FIGS. 1–4, the recoil starter 10 includes a winding housing 14 having a generally circular top wall 18 that defines an inner surface 22, and a circumferential sidewall 26 that generally surrounds the remaining components of the recoil starter 10. A series of mounting ears 30 extend from the circumferential sidewall 26 and can be used to secure the winding housing 14 to an internal combustion engine (not shown). The winding housing 14 also provides an opening 34 through which a starter rope 38 extends. A grommet 42 is positioned in the opening 34 to reduce wear on the starter rope 38 during recoil starter use.

The winding housing 14 also includes a winding core 46 that is coupled to the inner surface 22. The winding core 46 includes a central projection 50 that defines a central axis 54. The central projection 50 also defines a threaded opening 58 at its distal end. The winding core 46 further includes a spring tab 62 that is radially spaced from the central projection 50 and extends away from the inner surface 22. In the illustrated construction, the winding core 46 is joined to the winding housing 14 by welding. It should be appreciated however that the winding core 46 could be integrally formed with the winding housing 14, or could be joined to the winding housing 14 in a different manner.

Figure 5:
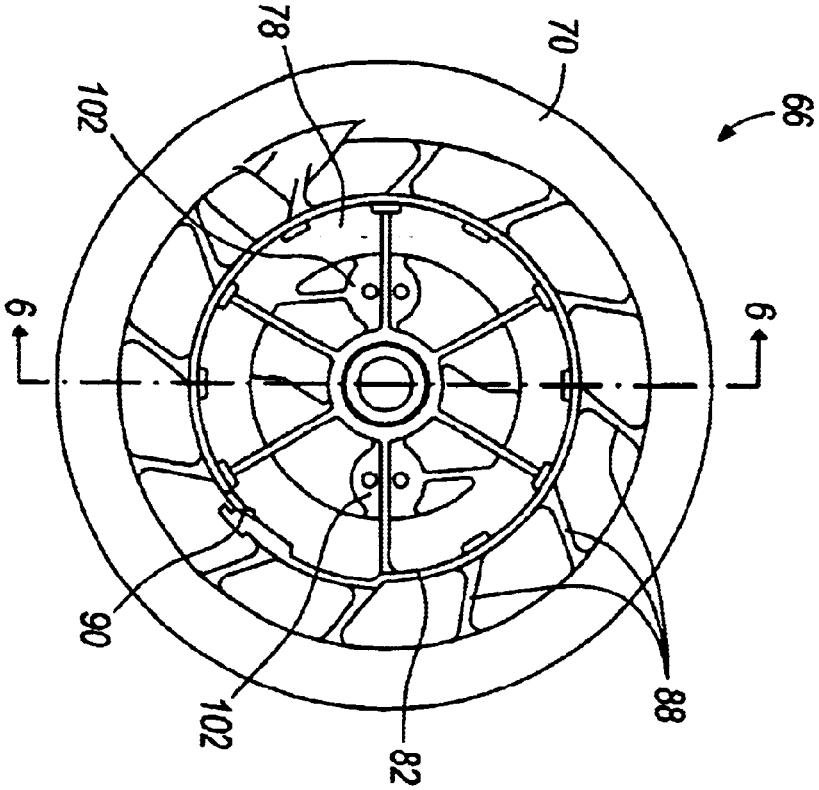
FIG. 5 is a top view of a reel of the recoil starter illustrated in FIG. 1.
Figure 6:
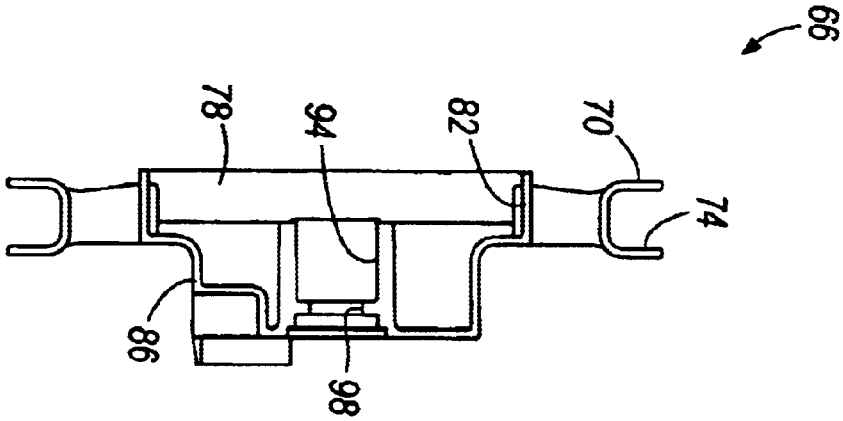
FIG. 6 is a section view taken along line 6—6 of FIG. 5.

Referring also to FIGS. 5 and 6, the recoil starter 10 also includes a reel 66. The reel 66 includes an outer annular portion 70 that defines a radially outwardly opening channel 74 that receives the starter rope 38. The reel also includes an inner portion 78 that includes a circumferential wall 82 and an axially extending projection 86. Radially extending webs 88 couple the inner portion 78 to the outer annular portion 70. The circumferential wall 82 defines a hook opening 90 and cooperates with the central projection 50 to define a substantially annular spring chamber 92 when the recoil starter 10 is assembled. The axially extending projection 86 defines a generally cylindrical bore 94 that opens axially toward the circumferential wall 82. A central aperture 98 extends through the bottom of the cylindrical bore 94. A set screw 100 extends through the central aperture 98 and threads into the threaded opening 58 of the winding core 46 to rotatably couple the reel 66 to the winding housing 14 when the recoil starter 10 is assembled (see FIG. 2).

The reel 66 also includes diametrically opposed ratchet support portions 102 defined by the axially extending projection 86. The ratchet support portions 102 support ratchet members 106 that cooperate with a ratchet guide plate 110 to selectively couple the reel 66 in a non-rotatable manner to the crankshaft (not shown) of the internal combustion engine. Specifically, when the reel 66 is rotated in a first direction with respect to the crankshaft, the ratchet members 106 move such that rotation of the reel 66 in the first direction imparts rotation to the crankshaft for starting of the engine. Once the engine is started, the crankshaft begins rotating faster than the reel 66 and the ratchet members 106 move to allow the reel 66 and the crankshaft to rotate independently of one another.

Figure 7:
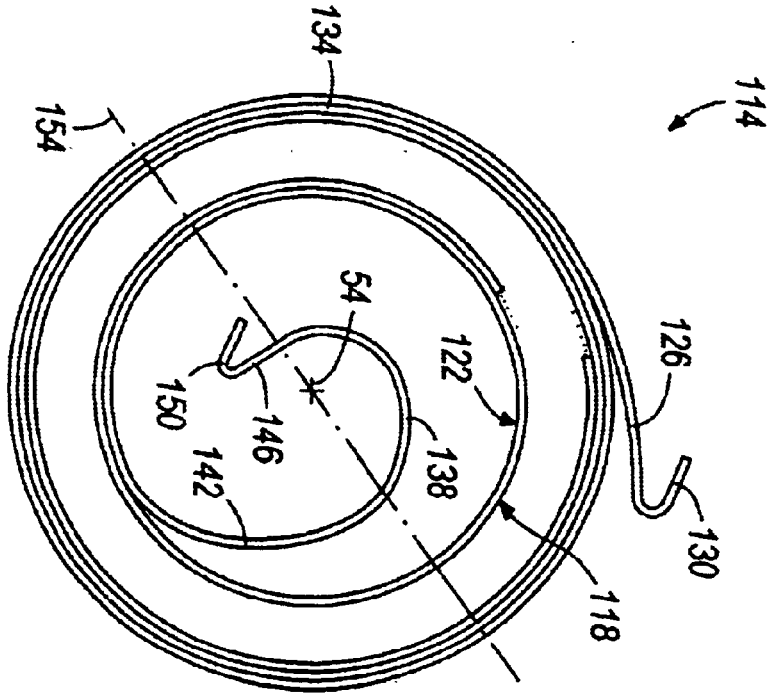
FIG. 7 is a top view of a spiral spring of the recoil starter illustrated in FIG. 1.
Figure 8:
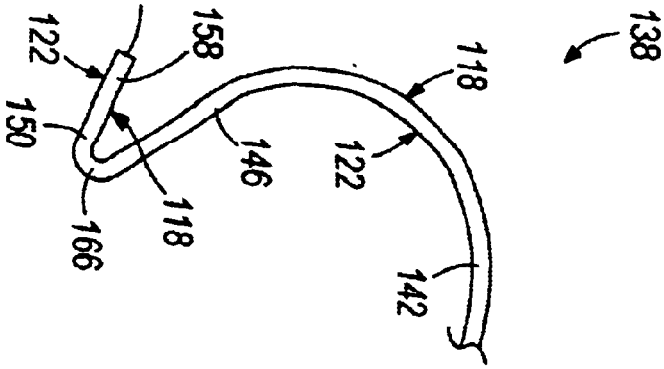
FIG. 8 is an enlarged view of an inner end portion of the spiral spring illustrated in FIG. 7.

Referring also to FIGS. 7 and 8, the recoil starter 10 further includes a generally spirally wound recoil spring 114. The recoil spring 114 is made from a generally continuous strip of spring steel and includes a first surface 118 and a second surface 122. The recoil spring 114 includes an outer coupling end portion 126 that defines a radially outwardly bent reel hook 130. The recoil spring 114 also includes a coiled portion 134 that is continuous with the outer end portion 126 and extends around the central axis 54 when the recoil starter 10 is assembled. The coiled portion 134 defines a plurality of spirally wound coils that converge radially inwardly such that the outermost coils have a larger average radius of curvature than the innermost coils. The specific number of individual coils can vary depending upon the particular application. The first surface 118 faces radially outwardly in the coiled portion 134 and the second surface 122 faces radially inwardly in the coiled portion 134.

The recoil spring 114 further includes an inner end portion 138 that is continuous with the coiled portion 134 and extends from the innermost coil radially inwardly and partially around the central axis 54. The inner end portion 138 includes a curved transition portion 142 extending directly from the coiled portion 134 and partially around the central axis 54. The inner end portion 138 also includes a substantially straight guide portion 146, and an inner hook portion 150 that is bent radially outwardly and away from the central axis 54. The transition portion 142 and guide portion 146 are configured such that a plane 154 extending through the central axis 54 intersects both the transition portion 142 and the guide portion 146. The hook portion 150 of the recoil spring 114 defines a substantially straight tab portion 158 that includes a terminal inner end 162 of the recoil spring 114, and a U-shaped bend portion 166 that extends between the guide portion 146 and the tab portion 158.

Figure 9:
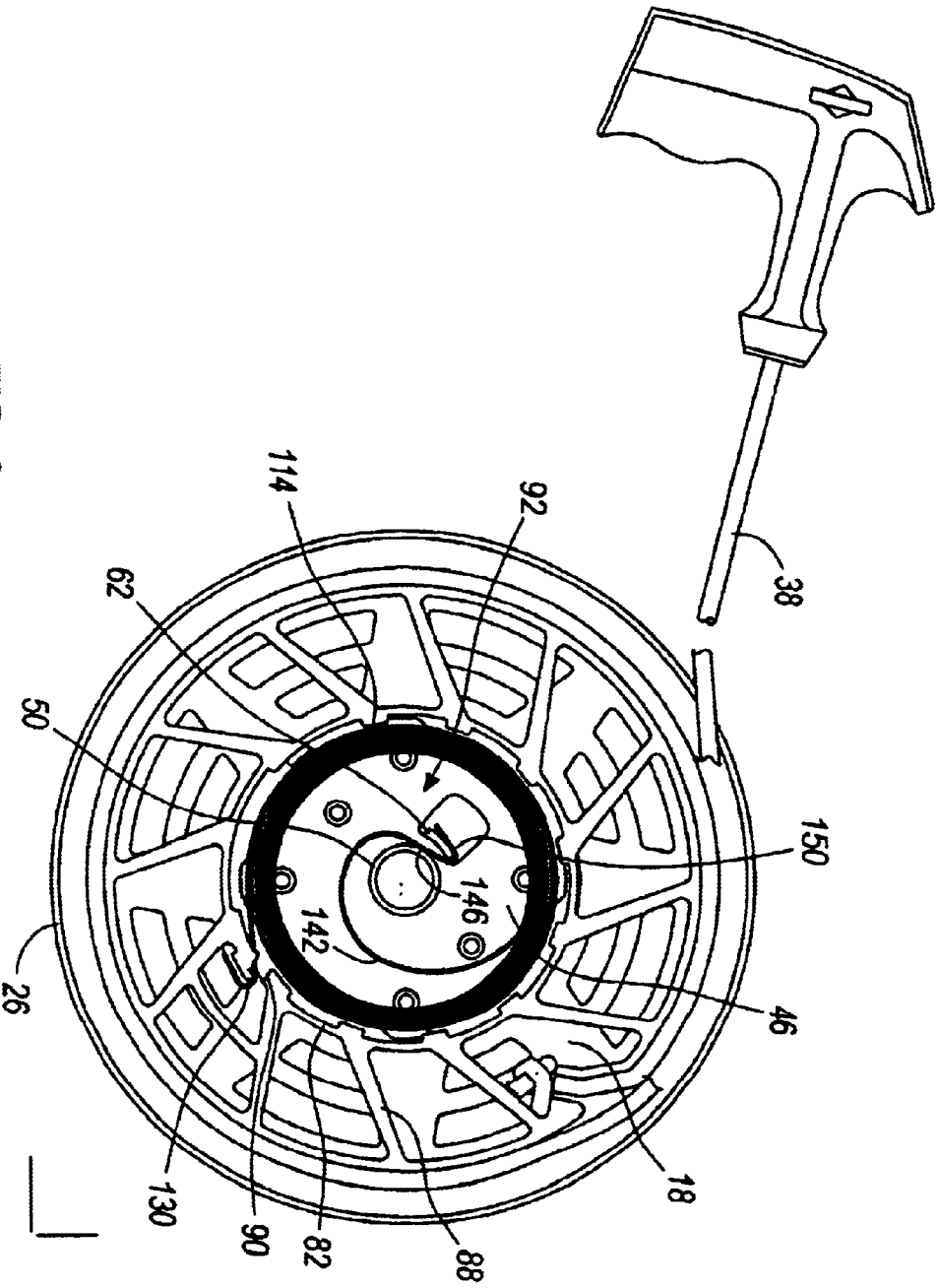
FIG. 9 is a section view taken alone line 9—9 of FIG. 2.

Referring now also to FIG. 9, the recoil spring 114 is illustrated positioned within the spring chamber 92. The reel hook 130 is received by the hook opening 90 defined by the circumferential sidewall 26 such that the outer end portion 126 is coupled for rotation with the reel 66. The transition portion 142 extends radially inwardly away from the coiled portion 134 toward the central projection 50 of the winding core 46. The guide portion 146 extends between the central projection 50 and the spring tab 62. The inner hook portion 150 bends radially away from the central projection 50 and the U-shaped bend portion 166 receives the spring tab 62. The configuration of the recoil spring 114 is such that the first surface 118 engages the spring tab 62. Engagement between the first surface 118 and the spring tab 62 holds the inner end portion 138 of the recoil spring 114 substantially fixed with respect to the winding housing 14.

When the starter rope 38 is pulled to start the engine, the reel 66 and the outer end portion 126 rotate about the central axis 54 in the first direction, thereby tensioning the recoil spring 114. When the starter rope 38 is subsequently released, energy stored in the recoil spring 114 causes the reel 66 to rotate in the second direction, thereby rewinding the starter rope 38 onto the outer annular portion 70 of the reel 66.

To make the recoil starter 10, the recoil spring 114 is positioned inside the circumferential wall 82 of the reel 66 such that the outer end portion 126 is received by the hook opening 90. The central projection 50 of the winding core 46 is inserted into the cylindrical bore 94 of the reel 66. The relative angular orientations of the reel 66 and the winding core 46 are selected such that as the central projection 50 is received by the cylindrical bore 94, the guide portion 146 of the recoil spring 114 is positioned between the central projection 50 and the spring tab 62. In addition, the tab portion 158 is positioned radially outwardly of the spring tab 62. Rotation of the reel 66 with respect to the winding housing 14 engages the inner hook portion 150, and more specifically, the U-shaped bend portion 166, with the spring tab 62, thereby limiting movement of the inner end portion 138 with respect to the winding housing 14.

Various features of the invention are set forth in the following claims.

What is claimed is:

1. A recoil starter comprising:

a winding housing including:
- a central axis;
- an inner surface; and
- a spring tab spaced from the central axis and extending from the inner surface;

a reel rotatably coupled to the winding housing for rotation about the central axis;

a spirally wound spring including:
- an outer end portion coupled to the reel;
- a coiled portion extending around the central axis;
- an inner end portion having:
  - a guide portion that extends between the central axis and the spring tab; and
  - a hook portion that extends radially outwardly from the central axis and that engages the spring tab to restrict movement of the inner end with respect to the winding housing.

2. The recoil starter of claim 1, wherein the inner end portion further comprises a transition portion disposed between the coiled portion and the guide portion.

3. The recoil starter of claim 2, wherein a plane extending through the central axis intersects the guide portion and the transition portion.

4. The recoil starter of claim 1, wherein the hook portion comprises:

a tab portion including a terminal end of the spring and positioned radially outwardly with respect to the spring tab; and a generally U-shaped bend portion that extends from the guide portion to the tab portion and receives the spring tab.

5. The recoil starter of claim 1, wherein the winding housing includes a central projection that intersects the central axis, and wherein the reel is rotatably coupled to the central projection.

6. The recoil starter of claim 1, wherein the reel comprises a circumferential wall that is substantially concentric to the central axis and defines an opening, and wherein the outer end portion comprises a second hook portion received by the opening to couple the outer end portion to the reel.

7. The recoil starter of claim 6, wherein the winding housing includes a central projection that intersects the central axis, wherein the circumferential wall and the central projection cooperate to define a spring chamber, and wherein the spring chamber is substantially annular.

8. The recoil starter of claim 1, wherein the winding housing includes a sidewall at least partially surrounding the reel.

9. The recoil starter of claim 1, wherein the spring comprises a generally spirally wound elongated strip having a first surface and a second surface, wherein in the coiled portion the first surface faces radially outwardly and the second surface faces radially inwardly, and wherein in the hook portion the first surface faces the spring tab.

10. A recoil starter comprising:

a winding housing including:

a central axis;

an inner surface; and a spring tab spaced from the central axis and extending from the inner surface;

a reel rotatably coupled to the winding housing for rotation about the central axis;

a spring including:

an elongated strip having a first surface and a second surface;

an outer end portion coupled to the reel;

a coiled portion extending around the central axis such that the first surface faces radially outwardly and the second surface faces radially inwardly with respect to the central axis; and an inner end portion including a hook portion formed such that the first surface faces the spring tab.

11. The recoil starter of claim 10, wherein the inner end portion further comprises a guide portion that extends between the central axis and the spring tab, and wherein in the guide portion the first surface faces the spring tab and the second surface faces the central axis.

12. The recoil starter of claim 11, wherein the inner end portion further comprises a transition portion extending between the coiled portion and the guide portion.

13. The recoil starter of claim 12, wherein a plane extending through the central axis intersects the guide portion and the transition portion.

14. The recoil starter of claim 10, wherein the hook portion comprises a tab portion including a terminal end of the spring and positioned radially outwardly with respect to the spring tab; and a generally U-shaped bend portion that receives the spring tab.

15. The recoil starter of claim 10, wherein the reel comprises a circumferential wall that is substantially concentric to the axis and defines an opening, and wherein the outer end portion comprises a second hook portion received by the opening to couple the outer end portion to the reel.

16. The recoil starter of claim 15, wherein the winding housing includes a central projection that intersects the central axis, wherein the circumferential wall and the central projection cooperate to define a spring chamber, and wherein the spring chamber is substantially annular.

17. A method for making a recoil starter, the method comprising:

providing a winding housing having an inner surface and a central axis and including a spring tab spaced from the central axis and extending from the inner surface;

providing a reel rotatably coupled to the winding housing for rotation about the axis, the reel and winding housing cooperating to at least partially define a spring chamber;

forming a spirally wound spring from an elongated strip of spring material, including:

forming an outer coupling portion;

forming a coiled portion continuous with the outer coupling portion and extending around the central axis;

forming a transition portion that extends radially inwardly away from the coiled portion; and forming an inner end portion extending from the transition portion, including:

forming a guide portion that extends from the transition portion; and forming an inner hook portion that extends radially away from the central axis;

coupling the outer coupling portion to the reel;

positioning the coiled portion inside the spring chamber;

positioning the guide portion between the central projection and the spring tab; and positioning the inner hook portion to receive the spring tab to restrict movement of the inner end with respect to the winding housing when the reel is rotated with respect to the winding housing.

18. The method of claim 17, wherein forming the inner hook portion includes forming a tab portion that defines a terminal end of the spring, and forming a generally U-shaped bend portion between the guide portion and the tab portion.

19. The method of claim 18, wherein positioning the inner hook portion to receive the spring tab includes positioning the tab portion radially outwardly with respect to the spring tab and engaging the U-shaped bend portion with the spring tab.

20. The method of claim 17, further comprising forming an opening in the reel, wherein forming the outer coupling portion comprises forming an outer hook portion; and wherein coupling the outer coupling portion to the reel comprises extending the outer hook portion through the opening in the reel.

* * * * *